US005380265A

United States Patent [19]

Giovinazzo et al.

[11] Patent Number: 5,380,265

[45] Date of Patent: Jan. 10, 1995

[54] APPARATUS FOR MANUALLY FOLDING SHEETS OF PAPER

[76] Inventors: Guido J. Giovinazzo, 90 Florence St., Hamilton, Ontario, Canada, L8R 1W7; Anthony J. Giovinazzo, 123 Longwood Road N., Hamilton, Ontario, Canada, L8S 3V8

[21] Appl. No.: 126,762

[22] Filed: Sep. 27, 1993

[51] Int. Cl.[6] ..... B65H 45/12

[52] U.S. Cl. ..... 493/405; 493/456

[58] Field of Search ..... 493/405, 455, 456

[56] References Cited

U.S. PATENT DOCUMENTS

| | | | |
|---|---|---|---|
| 192,102 | 6/1877 | Watriss | 493/405 |
| 623,882 | 4/1899 | Cameron et al. | 493/406 |
| 747,085 | 12/1903 | Rieffel | 493/405 |
| 797,864 | 8/1905 | Naylor | 493/405 |
| 1,164,844 | 12/1915 | Mudge | 493/405 |
| 1,346,109 | 7/1920 | Astley | 493/405 |
| 1,424,881 | 8/1922 | Cowen | 493/405 |
| 1,844,468 | 2/1932 | Fischer | 493/356 |
| 2,549,386 | 4/1951 | Reigh | 493/405 |
| 2,918,276 | 12/1959 | Weston | 493/405 |

*Primary Examiner*—William E. Terrell

*Attorney, Agent, or Firm*—Jeffrey T. Imai; Arne I. Fors; D. Doak Horne

[57] ABSTRACT

An apparatus for manually folding sheets of paper comprises a base plate having edges with a plurality of cut outs, at least two guides extending about the base plate, said guides defining a right angled corner, and a tongue having one end mounted to one of said two guides for extending over said base plate in a spaced parallel relation. The tongue has a cut on the end opposite the mounting end. The tongue has a size and shape and is positioned relative to said corner to fold said at least one sheet of paper into thirds. The sheet of paper is inserted between said tongue and said base, positioned into said right angled corner, folded about the tongue and removed therefrom in a folded condition.

1 Claim, 3 Drawing Sheets

APPARATUS FOR MANUALLY FOLDING SHEETS OF PAPER

FIELD OF INVENTION

This invention relates to an apparatus for manually folding letters.

BACKGROUND OF INVENTION

Manually folding sheets of paper for insertion into an envelope for mailing requires measuring and folding a sheet of paper with both hands, while the sheet of paper lies flat on a surface. This results in mis-measured folds and inefficient manoeuvres.

In an environment where more than one letter needs to be folded, but fewer letters than would be economical for an automatic folder, a significant amount of time and awkward maneuvers are expended to fold letters. Further, measuring lengths by guesstimate results in uneven folds that need to be refolded. Finally, manually folding on a desk or table does not allow for a space to pick up the folded letter.

There are devices available to assist in the folding of sheets of paper such as those described in U.S. Pat. Nos. 5,057,070 and 4,421,500. However these devices either only provide a mark identifying where to fold a sheet of paper or provide a very awkward apparatus for folding the paper. Neither of these devices improve the efficiency of folding a large number of sheets of paper.

SUMMARY OF THE INVENTION

The disadvantages of the prior art may be overcome by providing a plate with a shaped tongue raised from the surface of the plate allowing a sheet of paper to be inserted therebetween whereby the sheet of paper is folded about the tongue and subsequently removed in a folded condition.

It is further desirable to provide the plate with 90° guides to allow for positioning the sheet of paper relative to the tongue for folding the sheet of paper along fold lines perpendicular to the side edge of the sheet of paper.

According to one aspect of the invention, there is provided an apparatus for manually folding at least one sheet of paper. The apparatus comprises a base plate having edges with a plurality of cut outs, at least two guides extending about the base plate, said guides defining a right angled corner, and a tongue having one end mounted to one of said two guides for extending over said base plate in a spaced parallel relation. The tongue has a cut on the end opposite the mounting end. The tongue has a size and is positioned relative to said corner to fold said at least one sheet of paper into thirds. The tongue has edges adapted to crease paper. The sheet of paper is inserted between said tongue and said base, positioned into said right angled corner, folded about the tongue and removed therefrom in a folded condition.

DESCRIPTION OF THE DRAWINGS

In drawings which illustrate the embodiment of the invention.

DETAILED DESCRIPTION OF THE INVENTION

Figure 1:
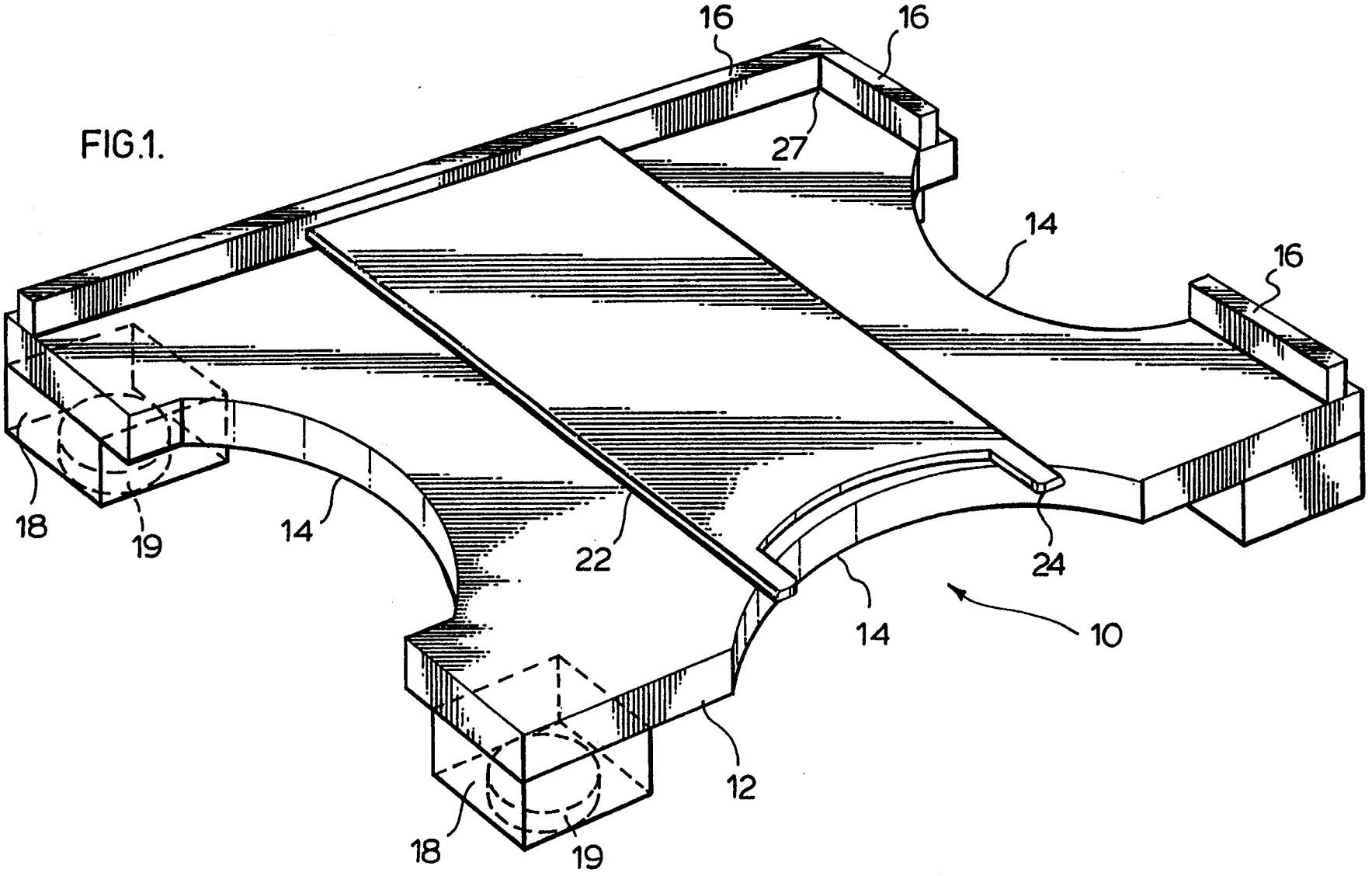
FIG. 1 is a perspective view of the apparatus according to the present invention.
Figure 2:
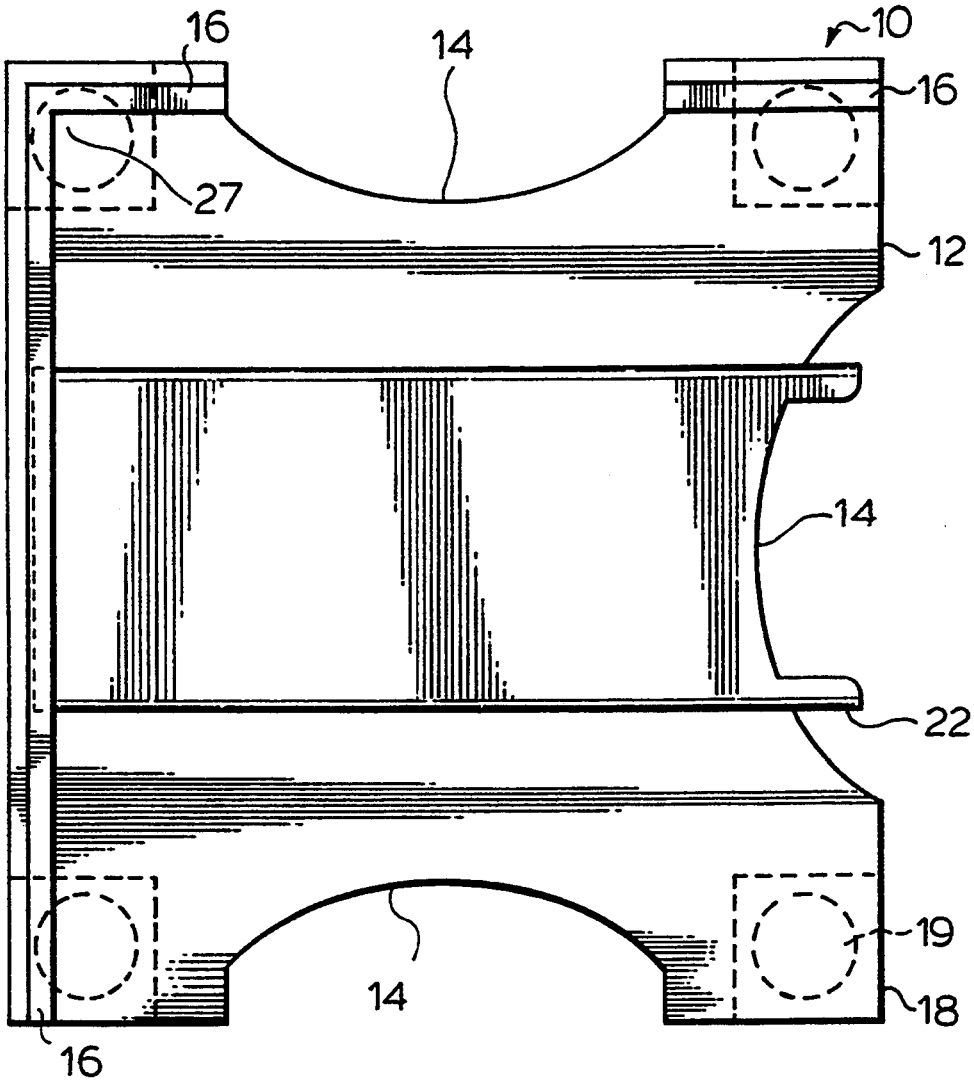
FIG. 2 is a top plan view of the apparatus of FIG. 1.
Figure 3:
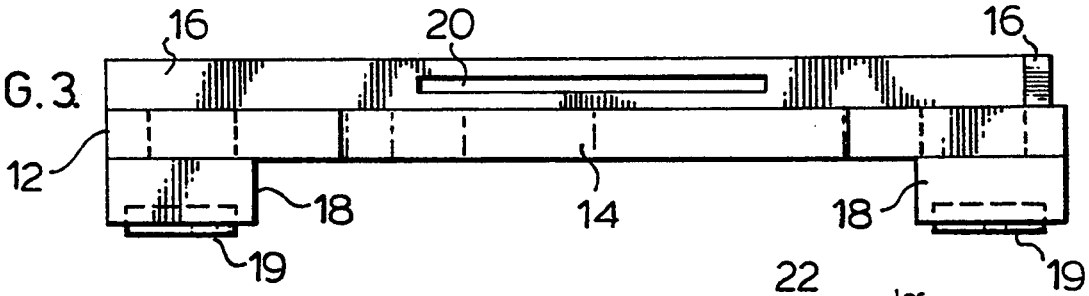
FIG. 3 is the side elevational view of the embodiment of FIG. 1 with the horizontal tongue removed.
Figure 4:
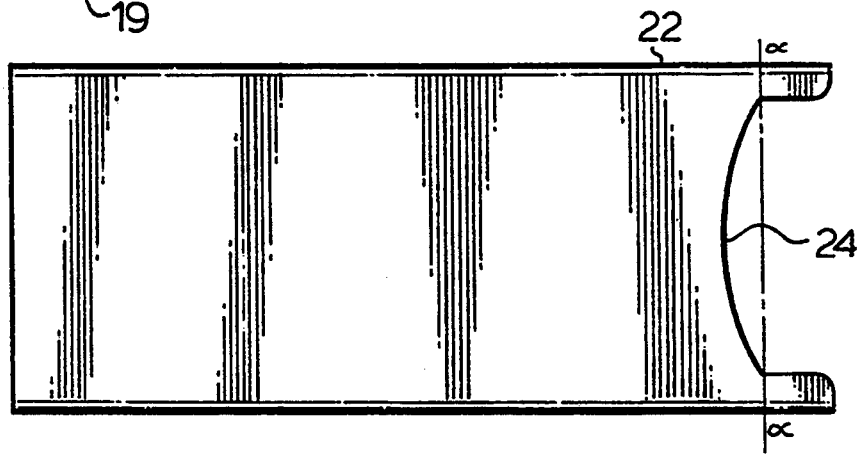
FIG. 4 is a top plan view of the tongue to be inserted into a slot located in the face of the vertical 90° guide in FIG. 2.

The folding apparatus of the present invention is generally illustrated as 10 in FIGS. 1 and 2. The apparatus 10 comprises a generally rectangular base 12 having three concave cut outs 14. Attached to the base 12 along the side edge and upper edge thereof are guides 16. Guides 16 extend substantially at 90° to the base 12.

The underside of the base 12 has four legs 18 located in each of the four corners. The legs 18 raise the apparatus 10 for clearance of the hand in the folding and extraction process. Rubber inserts may be inserted into cavities 19 to prevent the apparatus 10 from sliding along a smooth table surface.

Figure 5:
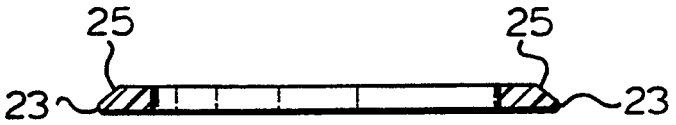
FIG. 5 is a sectional view of the tongue along the line $\propto - \propto$ of FIG. 4.
Figure 6:
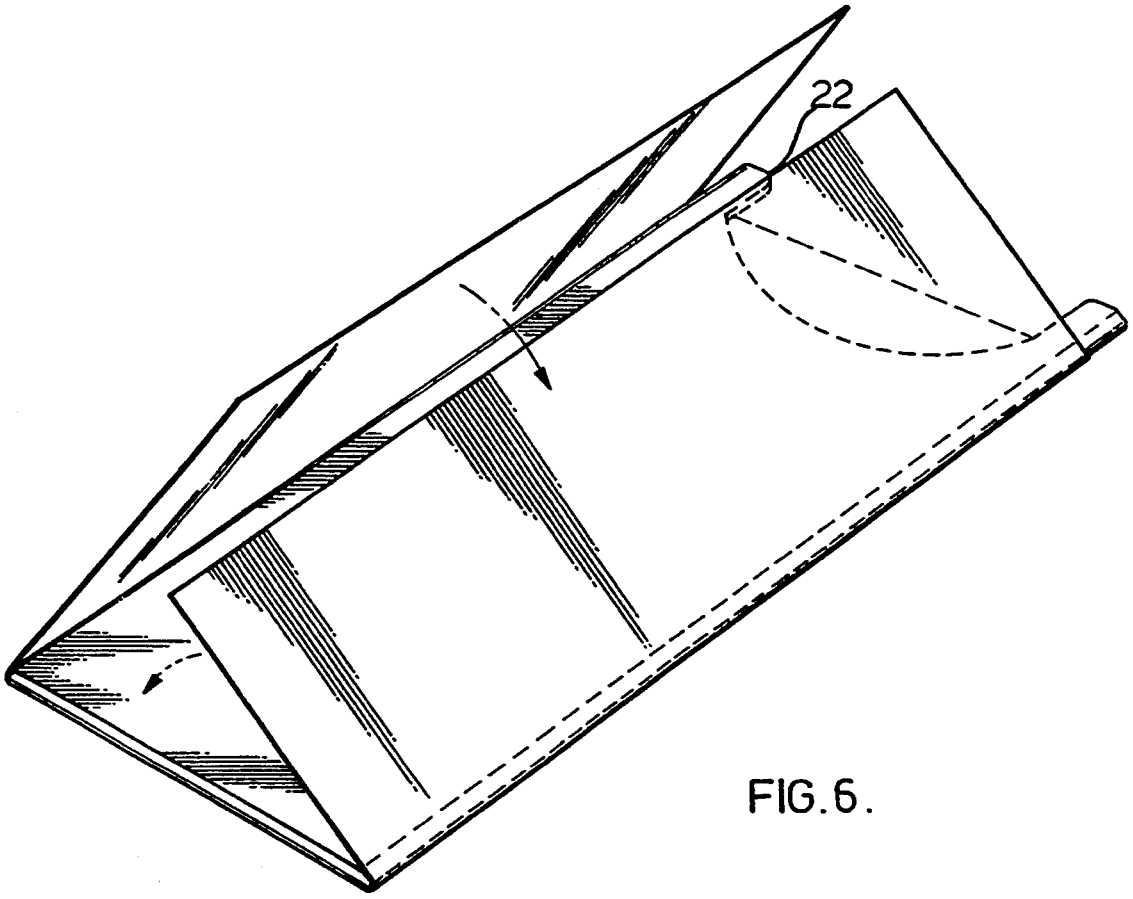
FIG. 6 is a perspective view of a sheet of paper folded about the tongue of FIG. 1.

Guide 16 has a longitudinally extending slot 20 for mounting and retaining one end of tongue 22. Tongue 22 is raised above the surface of base 12 to allow several sheets of paper to be inserted between the surface and the tongue. Tongue 22 has a general width of about one-third of the length of a standard sheet of paper (8.5×11 inches). Tongue 22 has a rounded edge 23 and sloped edge 25 (see FIG. 5) which improves the creasing ability of the tongue. Slot 20 is positioned about one-third of the distance measured from the upper corner 27 of the guide 16. Tongue 22 is inserted into slot 20 and fastened with a suitable fastener such as glue, nails, screws, etc. As is apparent, tongue 22 has a size and positioned relative to the corner to fold a sheet of paper into thirds.

The end opposite the mounting end of tongue 22 has a concave cut out 24 such that when the tongue is inserted into slot 20 cut out 24 is co-planar with the side cut out 14.

In use, the apparatus is placed on a level surface. A sheet of paper is inserted between the tongue 22 and the top surface of base 12. The sheet of paper is positioned into the corner of the guides 16. The user grips the sheet of paper, one hand at the top the other at the bottom, folding the sheet in position as is indicated by the arrows. The sheet of paper is folded about the tongue 22 and creased along edges 23 and 25. The user then grips the folded paper in the area of cut out 24 and removes the folded paper from the tongue 22.

As is apparent the cut outs 14 and 24 allow for easy gripping of the sheet of paper on top and bottom for folding and for easy removal of the folded sheet of paper.

Although the disclosure describes and illustrates a preferred embodiment of the invention, it is to be understood that the invention is not limited to this particular embodiment. Many variations and modifications will now occur to those skilled in the art. For a definition of the invention, reference is to be made to the appended claims.

We claim:

1. An apparatus for manually folding at least one standard sheet of paper, said apparatus comprising a base plate having a top, a bottom and a side edges, each of said edges having a cut out therealong, at least two guides extending substantially perpendicular from the base plate about the top and a side edge opposite said side edge having the cut out, said guides defining a right angled corner, a tongue having one end mounted to one of said two guides for extending over said base plate in a spaced parallel relation, said tongue having a cut out on an end opposite the mounting end, said tongue cut out aligning with said cut out along said side edge of said base plate, said tongue having a size and positioned relative to said corner to fold said at least one sheet of paper into thirds, said tongue having two pairs of edges, each comprising a rounded edge and a tapered edge adapted for creasing said at least one sheet of paper, whereby at least one sheet of paper is insertable between said tongue and said base, positionable into said right angled corner and extendable over said cut outs of said base plate, said at lest one sheet of paper is foldable about said tongue and removable therefrom in a folded condition by gripping said sheet of paper in the area of said cut outs.

* * * * *